US008105091B2

(12) United States Patent
Nishihira et al.

(10) Patent No.: US 8,105,091 B2
(45) Date of Patent: Jan. 31, 2012

(54) APPARATUS FOR AND METHOD OF MAGNETICALLY COUPLING STANDARD ELECTRICAL PLUGS

(75) Inventors: Lance Sushin Nishihira, Union City, CA (US); Thomas Sukei Nishihira, Newark, CA (US)

(73) Assignee: Lance Sushin Nishihira, Union City, CA (US)

( * ) Notice: Subject to any disclaimer, the term of this patent is extended or adjusted under 35 U.S.C. 154(b) by 0 days.

(21) Appl. No.: 12/637,538

(22) Filed: Dec. 14, 2009

(65) Prior Publication Data

US 2010/0159713 A1 Jun. 24, 2010

Related U.S. Application Data

(60) Provisional application No. 61/138,954, filed on Dec. 19, 2008.

(51) Int. Cl.
*H01R 11/30* (2006.01)

(52) U.S. Cl. ..... 439/39; 439/540.1

(58) Field of Classification Search ..... 439/18, 439/23, 38, 39, 540.1, 717, 928
See application file for complete search history.

(56) References Cited

U.S. PATENT DOCUMENTS

| | | | | |
|---|---|---|---|---|
| 3,363,214 | A | 1/1968 | Wright | |
| 3,521,216 | A | 7/1970 | Tolegian | |
| 3,786,391 | A * | 1/1974 | Mathauser | 439/39 |
| 3,808,577 | A * | 4/1974 | Mathauser | 439/39 |
| 4,156,265 | A | 5/1979 | Rose | |
| 7,311,526 | B2 | 12/2007 | Rohrbach et al. | |

OTHER PUBLICATIONS

International Search Report and Written Opinion dated Feb. 19, 2010, International Application No. PCT/US2009/068545, Filed Dec. 17, 2009, Lance Nishihira.

Non-Final Office Action dated Jun. 10, 2011, U.S. Appl. No. 13/085,382, filed Apr. 12, 2011, Lance Sushin Nishihira et al.

* cited by examiner

*Primary Examiner* — Khiem Nguyen
(74) *Attorney, Agent, or Firm* — Haverstock & Owens LLP

(57) ABSTRACT

An adapter includes a device-side component and a wall-side component. The device-side component has a male socket receptacle to receive an electrical plug and a male socket opposite the male socket receptacle. The wall-side component has a female socket plug to insert into an electrical outlet and a female socket opposite the female socket plug. The male socket is configured to interface with the female socket, regardless of orientation of the male socket with respect to the female socket.

22 Claims, 18 Drawing Sheets

APPARATUS FOR AND METHOD OF MAGNETICALLY COUPLING STANDARD ELECTRICAL PLUGS

RELATED APPLICATIONS

The present application claims priority to U.S. Provisional Patent Application 61/138,954, filed on Dec. 19, 2008, and entitled "Apparatus for Magnetically Coupling Standard Electrical Plugs" to the same inventors under U.S.C. section 119(e). This application incorporates U.S. Provisional Patent Application 61/138,954, filed on Dec. 19, 2008, and entitled "Apparatus for Magnetically Coupling Standard Electrical Plugs" to the same inventors by reference in its entirety.

FIELD OF THE INVENTION

The present invention relates to electrical plugs, and more particularly to an apparatus for and method of magnetically coupling electrical plugs for standard electrical service.

BACKGROUND

An electronic equipment typically has an electrical plug. FIG. 1A illustrates a three-prong electrical (Type B) plug 100, while FIG. 1B illustrates a two-prong electrical (Type A) plug 100'. An electrical plug 100, 100' is a male electrical connector having supply leads 105, 105', including both a hot supply lead and a neutral supply lead and sometimes a ground supply lead. The supply leads 105, 105' connect mechanically and electrically to a female electrical connector, such as an electrical outlet.

FIG. 1C illustrates a faceplate 110 having three-prong electrical outlets. Each electrical outlet 115 has two vertical slots 120, 125 and a round hole 130 centered below the slots 120, 125. The left slot 120 is a neutral slot. The right slot 125 is a hot slot. The round hole 130 is a ground slot. Behind the faceplate 110, for each electrical outlet 115, are three separate wires (not illustrated) that are connected to the slots. A hot wire (usually a black or blue wire) is connected to the hot slot and brings power to the electrical outlet. The neutral wire (usually a white wire) is connected to the neutral slot and to an electrical panel of the house or building. The neutral wire returns power back to the electrical panel from the electrical outlet. The ground hole is connected to a wire (usually a green wire) that is buried into the ground beneath the house or building. FIG. 1D illustrates a faceplate 110' having two-prong electrical outlets 115', which is similarly configured as the faceplate 100 except that the two-prong electrical outlets 115' lack ground slots. These two-prong electrical outlets are the norm in older homes.

An electrical outlet 115, 115' is dormant until the plug 100, 100' of an electrical device is slotted into place, because the hot wire and neutral wire are not connected with each another to form a complete circuit. To bring power to the electronic equipment, the circuit must be completed. As such, the plug 100, 100' must be slotted into place to pass electricity into the hot socket 120, into the hot side of the device's plug, into the electronic equipment, then out through the neutral side of the device's plug, and back into the neutral socket 125 and to the electrical panel.

To slot the electrical plug into the electrical outlet, the electrical plug must be precisely oriented. However, in hard to reach areas, limited access areas or in low lighting settings, slotting the electrical plug in place can be difficult, given the characteristics (e.g., size and location of each slot/hole) of the electrical outlet. In such scenarios, one normally must first feel where the slots of the electrical outlet are located with one hand and, with the other hand, orient the electrical plug properly, and then slowly move the hand over the slots away as the other hand moves in toward the electrical outlet with the electrical plug. However, even in a proper setting, to a person of limited dexterity and/or vision, slotting the plug in place can be a great challenge.

Fitt's law is a model that determines that the efficiency of moving toward a target area is relative to the distance and size of the target. Simplistically put, the bigger the size of the target is, the more efficient one is in hitting the target. Analogously, a user can be more efficient in plugging an electrical plug into an electrical outlet if the size of the electrical outlet (i.e., the target) is bigger.

SUMMARY OF THE DISCLOSURE

In one aspect, an adapter includes a non-orientation dependent pair of connectors. The first connector includes a male socket receptacle and a male socket. The male socket is at an opposite end of the male socket receptacle. In some embodiments, the male socket has at least two concentric rings that protrude from the first connector. The second connector includes a female socket plug and a female socket. The female socket is at an opposite end of the female socket plug. The female socket mates with the male socket, regardless of how the male socket is oriented with respect to the female socket.

In yet another aspect, an adapter includes orientation independent connectors. The connectors are typically magnetically attractive. The connectors include a first connector and a second connector. The first connector is configured to couple with an electronic device. The first connector includes a first interface. The second connector is configured to couple with an electrical outlet. The second connector includes a second interface. Typically, the first interface and the second face are pulled together and mate when the first connector is within an attraction vicinity of the second connector.

In another aspect, an adapter includes a first removable component and a second removable component. The first removable component includes a piece capable of being attracted by magnets and a first removable component interface. The first removable component interface typically has a radial design including a plurality of rings. The second removable component includes at least one magnet and a second removable component interface. The second removable component interface typically receives the plurality of rings. In some embodiments, the magnet attracts the piece capable of being attracted by magnets to guide the first removable component into electrical contact with the second removable component, regardless of how the first removable component interface is oriented with respect to the second removable component interface.

In yet another aspect, an adapter includes a device-side component and a wall-side component. The device-side component typically includes a first device face configured to receive an electrical plug, a second device face opposite the first device face, an L-receptacle configured to receive a first prong of the electrical plug, an L-ring abutting the L-receptacle, an N-receptacle configured to receive a second prong of the electrical plug, and an N-ring abutting the N-receptacle. Typically, a portion of the L-ring and a portion of the N-ring protrude from the second device face. In some embodiments, the device-side component further includes a ground receptacle configured to receive a third prong of the electrical plug. In some embodiments, the device-side component further includes a ring capable of being attracted by at least one magnet. In some embodiments, the device-side component further includes at least one magnet.

The wall-side component typically includes a first wall face configured to insert into an electrical outlet and a second wall face opposite the first wall face. The second wall face is typically configured to mate with the second device face, regardless of orientation of the second device face with respect to the second wall face. The wall-side component further includes an L-conductor configured to contact the portion of the L-ring protruding from the second device face, and an L-plug coupled to the L-conductor. Typically, a portion of the L-plug is configured to insert into a first slot of the electrical outlet. The wall-side component further includes an N-conductor configured to contact the portion of the N-ring protruding from the second device face, and an N-plug coupled to the N-conductor. Typically, a portion of the N-plug is configured to insert into a second slot of the electrical outlet. In some embodiments, the wall-side component further includes a ground plug configured to receive a ground receptacle. Typically, a portion of the ground plug is configured to insert into a hole of the electrical outlet. Alternatively, the wall-side component includes a grounding wire. In some embodiments, the wall-side component further includes at least one magnet.

In yet another aspect, a device-side component of an adapter includes a receptacle housing including an interface to receive an electrical plug, and a receptacle base coupled to the receptacle housing. The receptacle base typically includes an interface to couple with a wall-side component. The device-side component further includes an L-receptacle configured to receive a first blade of the electrical plug, and an L-ring coupled to the L-receptacle. Typically, a portion of the L-ring extends away from a bottom of the receptacle base. The device-side component further includes an N-receptacle configured to receive a second blade of the electrical plug, and an N-ring coupled to the N-receptacle. Typically, a portion of the N-ring extends away from the bottom of the receptacle base. The L-ring and N-ring are preferably concentric rings. In some embodiments, the device-side component further includes a ground receptacle configured to receive a ground prong of the electrical plug. Typically, a portion of the ground receptacle extends through and away from the receptacle base. In some embodiments, the device-side component further includes a presser. In some embodiments, the device-side component further includes an element capable of being attracted by a magnet. That element can either be formed of a metal that can be attracted by a magnet or another magnet. The element typically couples to the bottom of the receptacle base. In some embodiments, the device-side component is formed as part of an electrical device.

In yet another aspect, a wall-side component of an adapter includes a socket housing including an interface to couple to a device-side component, wherein the interface includes two recessed, concentric rings. The wall-side component further includes a plug base coupled to the socket housing, wherein the plug base includes an interface to plug into an electrical outlet. The wall-side component further includes an L-conductor configured to contact an L-ring of the device-side component, and an L-plug coupled to the L-conductor. Typically, a portion of the L-plug extends away from a bottom of the plug base, and the portion of the L-plug is configured to insert into a first slot of the electrical outlet. The wall-side component further includes an N-conductor configured to contact an N-ring of the device-side component, and an N-plug coupled to the N-conductor. Typically, a portion of the N-plug extends away from the bottom of the plug base, and the portion of the N-plug is configured to insert into a second slot of the electrical outlet. In some embodiments, the wall-side component includes at least one magnet positioned within the socket housing. In some embodiments, the wall-side component includes an enhanced ring sized and adapted to fit within the socket housing. In some embodiments, the wall-side component includes an insulator sized and adapted to fit within the socket housing. In some embodiments, the wall-side component includes a ground plug configured to receive a ground receptacle of a device-side component. Typically, a portion of the ground plug is configured to insert into a third slot of the electrical outlet. Alternatively, the wall-side component includes a grounding wire. In some embodiments, the wall-side component is formed as part of an electrical outlet, a power strip, or the like.

In yet another aspect is for a method of using an adapter. The adapter includes a wall-side component and a device-side component. The method includes providing an attraction vicinity of the wall-side component, positioning the device-side component within the attraction vicinity, attracting the device-side component toward the wall-side component, and coupling the device-side component and the wall-side component, regardless of face orientation.

In yet another aspect is for a method of manufacturing a device-side component of an adapter. The method includes coupling an N-receptacle to an N-ring via a first portion of apertures of a receptacle base, wherein the N-receptacle is positioned within the receptacle base and a portion of the N-ring extends away from a bottom of the receptacle base. The method further includes coupling an L-receptacle to an L-ring via a second portion of apertures of the receptacle base, wherein the L-receptacle is positioned within the receptacle base and a portion of the L-ring extends away from the bottom of the receptacle base. The method further includes enclosing the N-receptacle and the L-receptacle with a receptacle housing. In some embodiments, the method includes, after the step of coupling an L-receptacle to an L-ring, threading a vertical prong of a ground receptacle through a center hole of the receptacle base, and securing a presser to the receptacle base.

In yet another aspect is for a method of manufacturing a wall-side component of an adapter. The method includes coupling an N-plug to an N-conductor via a first vertical slot of a plug base, wherein the N-conductor is positioned within the plug base and a portion of the N-plug extends away from a bottom of the plug base. The method further includes coupling an L-plug to an L-conductor via a second vertical slot of the plug base, wherein the L-conductor is positioned within the plug base and a portion of the L-plug extends away from the bottom of the plug base. The method further includes enclosing the N-conductor and the L-conductor with a socket housing. In some embodiments, the method includes, before the step of coupling an N-plug to an N-conductor, positioning a plurality of magnets within the socket housing and coupling an insulator within the socket housing. In some embodiments, the step of positioning the plurality of magnets includes alternating the placement of each magnet based on polarity. In some embodiments, the method includes, after the positioning a plurality of magnets within the socket housing, coupling an enhanced ring within the socket housing.

BRIEF DESCRIPTION OF THE DRAWINGS

The novel features of the invention are set forth in the appended claims. However, for the purpose of explanation, several embodiments of the invention are set forth in the following figures. These embodiment are not intended to limit the scope the attached claims.

DETAILED DESCRIPTION

In the following description, numerous details are set forth for purposes of explanation. However, one of ordinary skill in the art will realize that the invention can be practiced without the use of these specific details. Thus, the present invention is not intended to be limited to the embodiments shown but is to be accorded the widest scope consistent with the principles and features described herein or with equivalent alternatives.

Reference will now be made in detail to implementations of the present invention as illustrated in the accompanying drawings. The same reference indicators will be used throughout the drawings and the following detailed description to refer to the same or like parts.

Figure 1A:
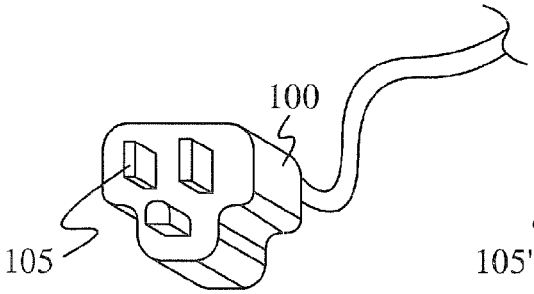
Fig. 1A (Prior Art)
FIGS. 1A-1B illustrate exemplary electrical plugs in the prior art.
Figure 1B:
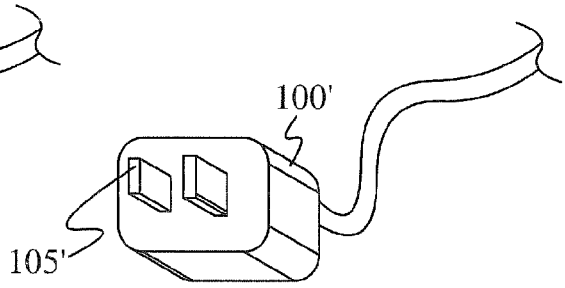
Fig. 1B (Prior Art)
Figure 1C:
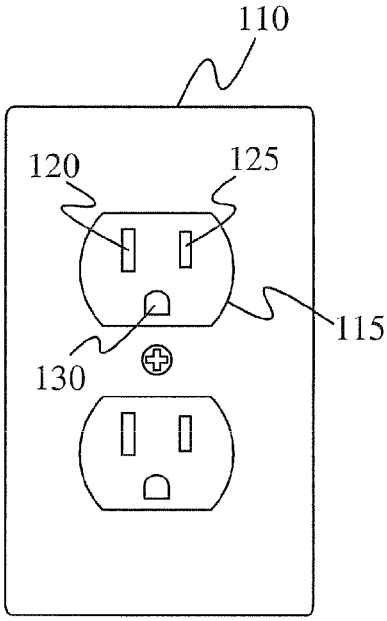
Fig. 1C (Prior Art)
FIGS. 1C-1D illustrate exemplary electrical outlets in the prior art.
Figure 1D:
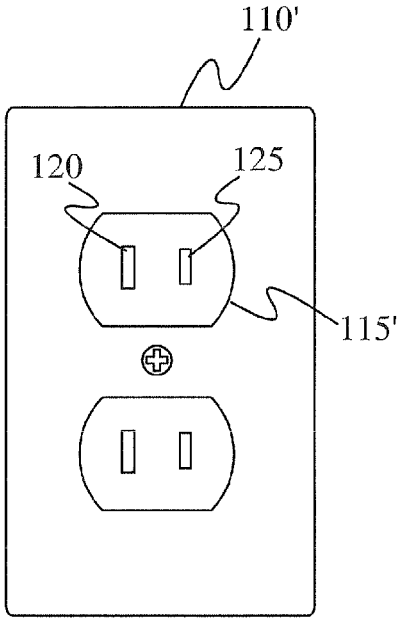
Fig. 1D (Prior Art)

Embodiments of the present invention are directed to an apparatus for and method of magnetically coupling standard electrical plugs. In some embodiments, the apparatus is an adapter that comprises two components: a device-side component and a wall-side component. The wall-side component typically plugs into an electrical outlet, such as that illustrated in FIG. 1C. The device-side component typically receives an electrical plug of a device, such as that illustrated in FIG. 1A. In use, the device-side component and the wall-side component electrically and magnetically couple together, allowing electricity to flow to the electrical device via the adapter.

Figure 4:
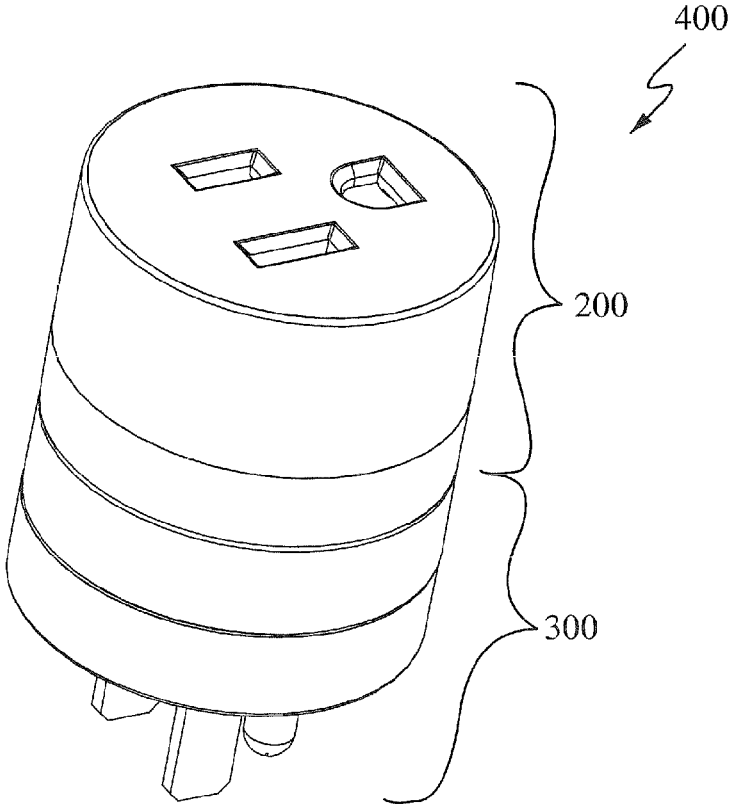
FIG. 4 illustrates an isometric view of an exemplary adapter in accordance with the present invention.

For the sake of simplicity and brevity, only the adapter for Type B electrical plugs and electrical outlets will be discussed, although adapters for other types of electrical plugs and electrical outlets are similarly configured. FIG. 4 illustrates an isometric view of the adapter 400 for Type B electrical plugs and electrical outlets in accordance with the present invention. The adapter 400 is configured to function when a device-side component 200 and a wall-side component 300 are engaged.

The device-side component and the wall-side component each meets the National Electrical Code. Specifically, the male socket receptacle (of the device-side component) and the female socket plug (of the wall-side component) each complies with the ANSI/NEMA WD6 standard; and, the male socket (of the device-side component) and the female socket (of device-side component) each complies with the UL 498A standard. Each of the components will now be discussed in turn below.

Device-Side Component Pieces

Figure 2A:
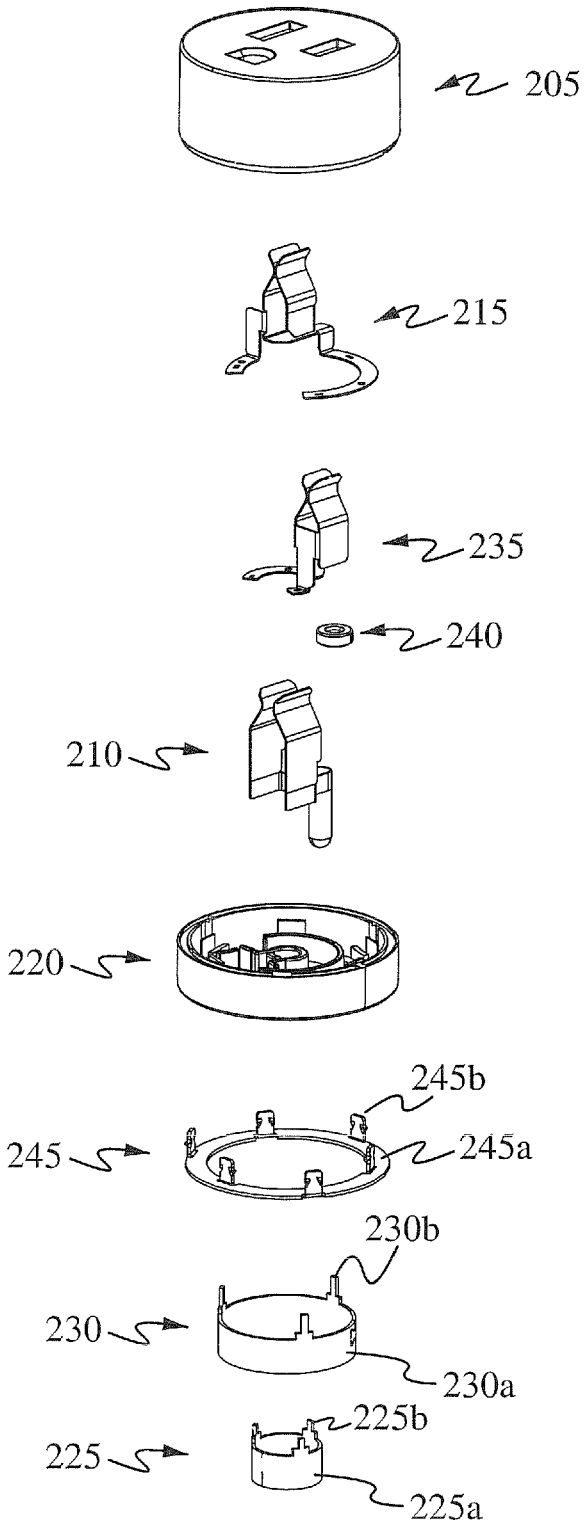
FIG. 2A illustrates an exploded view of various pieces of the device-side component in accordance with the present invention.

FIG. 2A illustrates an exploded view of various pieces of a device-side component 200 in accordance with the present invention. The device-side component 200 typically includes a receptacle housing 205, a ground receptacle 210, an L-receptacle 215, a receptacle base 220, an N-ring 225, an L-ring 230, an N-receptacle 235, a presser 240, and a contact ring 245 that is capable of being attracted by a magnet. The receptacle housing 205, the presser 240 and the receptacle base 220 are typically made of non-conductive material, such as plastic. The contact ring 245 is typically made of steel and is zinc plated. The ground receptacle 210, the N-receptacle 235, the L-receptacle 215, the N-ring 225, and the L-ring 230 are typically made of conductive material, such as metal including phosphor bronze or beryllium copper.

Figure 2B:
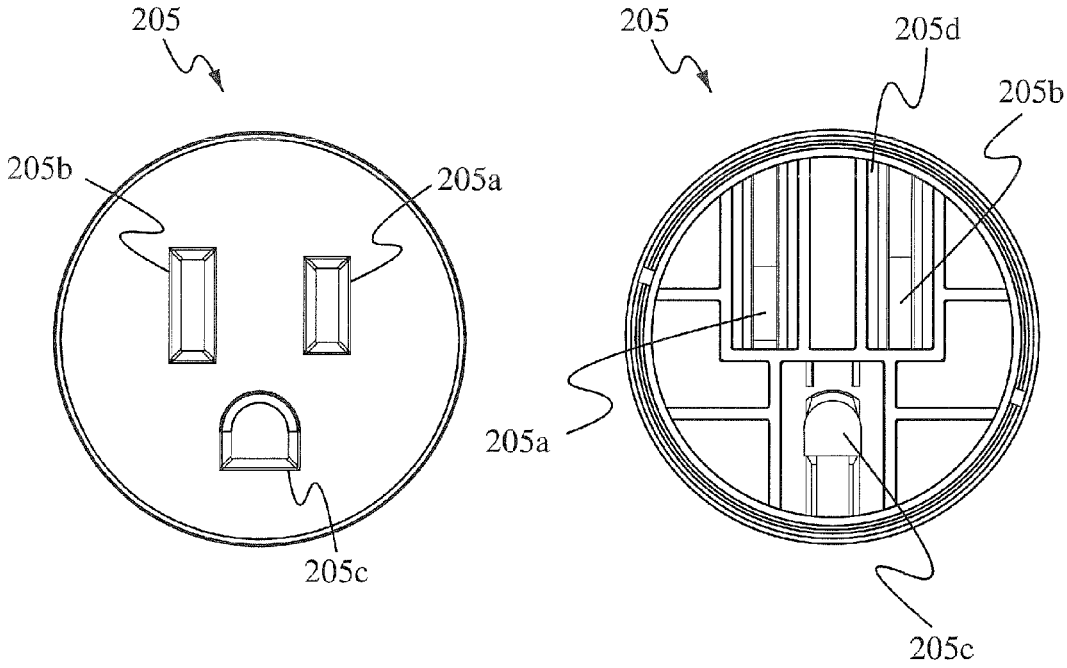
FIGS. 2B-2F illustrate the pieces of the device-side component in accordance with the present invention.

FIG. 2B illustrates a front view and a back view of the receptacle housing 205 in accordance with the present invention. As illustrated, the receptacle housing 205 typically comprises two vertical slots 205*a*, 205*b*. In some embodiments, the receptacle housing 205 further comprises a substantially round hole 205*c* centered below the slots. The N-receptacle 235, the L-receptacle 215 and the ground receptacle 210 are typically positioned behind the two vertical slots 205*a*, 205*b* and the round hole 205*c*, respectively, to receive supply leads of an electrical plug via the two vertical slots 205*a*, 205*b* and the round hole 205*c*. The receptacle housing 205 typically comprises a plurality of walls 205*d* therein to provide structural integrity of the receptacle housing 205. In some embodiments, the receptacle housing 205 is made by injection molding. Although the receptacle housing 205 is shown as having a circular shape, other shapes are contemplated.

Figure 2C:
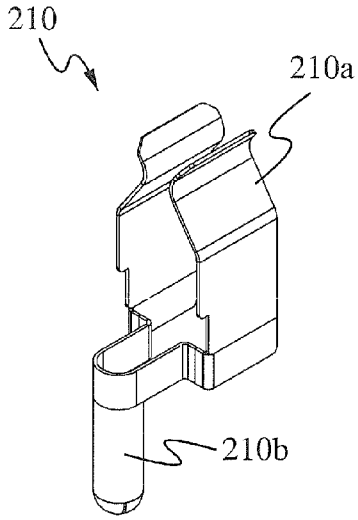

FIG. 2C illustrates an isometric view of the ground receptacle 210 in accordance with the present invention. The ground receptacle 210 typically comprises a pair of receptors 210*a* for receiving a ground supply lead of an electrical plug. The pair of receptors 210*a* is integrally coupled to a vertical prong 210*b*. In some embodiments, the ground receptacle 210 is formed in a single stamping operation on sheet metal.

Figure 2D:
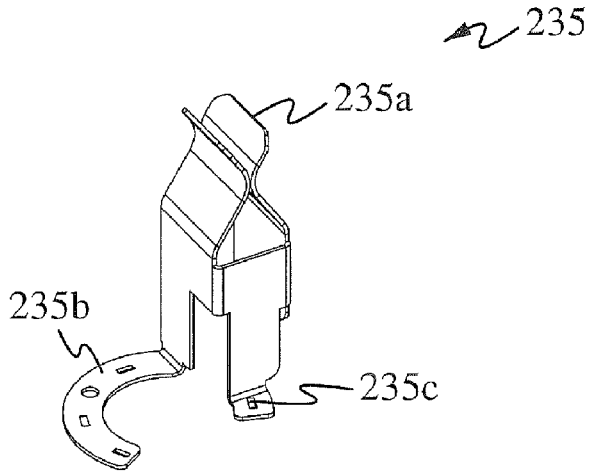

FIG. 2D illustrates an isometric view of the N-receptacle 235 in accordance with the present invention. The N-receptacle 235 typically comprises a pair of receptors 235*a* for receiving a hot supply lead of an electrical plug. The pair of receptors 235*a* is integrally coupled to a horizontal open ring 235*b*, near one end of the open ring 235*b*. The ring 235*b* comprises a plurality of openings 235*c*. In some embodiments, the N-receptacle 235 is formed in a single stamping operation on sheet metal.

Figure 2E:
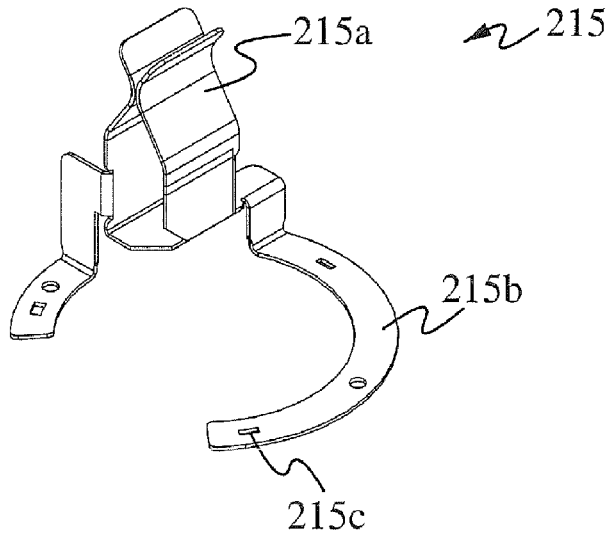

FIG. 2E illustrates an isometric view of the L-receptacle 215 in accordance with the present invention. The L-receptacle 215 comprises a pair of receptors 215*a* for receiving a neutral supply lead of an electrical plug. The pair of receptors 215*a* is integrally coupled to a horizontal open ring 215*b*, near one end of the open ring 215*b*. The ring 215*b* comprises a plurality of openings 215*c*. In some embodiments, the L-receptacle 215 is formed in a single stamping operation on sheet metal. In some embodiments, the open ring 215*b* is larger than the open ring 235*b*.

As illustrated in FIG. 2A, the presser 240 is configured to couple to a top of the vertical prong 210*b* of the ground receptacle 210. In some embodiments, the presser 240 is made by injection molding.

Figure 2F:
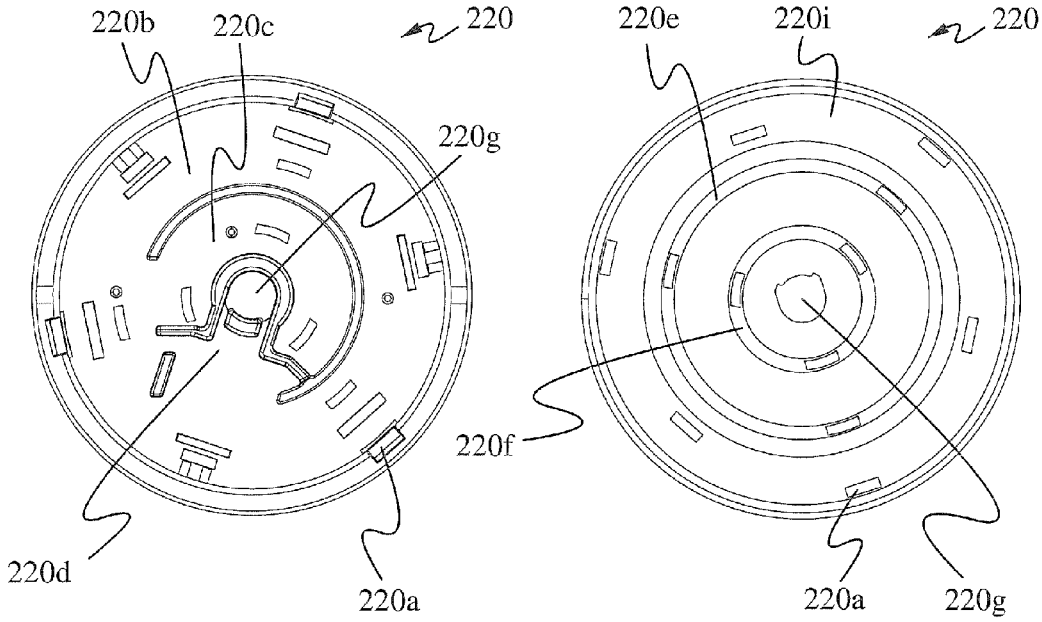

FIG. 2F illustrates a front view and a back view of the receptacle base 220 in accordance with the present invention. The receptacle base 220 comprises a center hole 220*g*, a plurality of apertures 220*a* and a plurality of walls that defines a plurality of sections 220*b*-220*d* within the receptacle base 220. The section 220*b* is configured to accept the L-receptacle 215; the section 220*c* is configured to accept the N-receptacle 235; and, the section 220*d* is configured to accept the ground receptacle 210. The receptacle base 220 comprises a plurality of concentric rings 220*i*, 200*e*, 200*f* etched on the back side of the receptacle base 220 to help guide placement of the contact ring 245, the L-ring 230 and the N-ring 225, respectively. In some embodiments, the first concentric ring 220*i* includes first and second portions of the plurality of apertures 220*a*. The first and second portions of the plurality of apertures 220*a* are typically staggered along the inner and outer diameters of the first concentric ring 220*i*, as illustrated. The second concentric ring 200*e* comprises a third portion of the plurality of apertures 220*a*. The third concentric ring 200*f* comprises a fourth portion of the plurality of apertures 200*a*. In some embodiments, the receptacle base 220 is made by injection molding.

Referring back to FIG. 2A, the contact ring 245 comprises a flat ring 245*a* with a plurality of extenders 245*b*. The plurality of extenders 245*b* is sized and configured to insert through the first and second portions of the plurality of apertures 220*a*, allowing the flat ring 245*a* to be positioned flush against the back side of the receptacle base 220. In some embodiments, each end of the extenders 245*b* are notched to fit through the first and second portions of the plurality of apertures 220*a* and to, thereby, securely couple the contact ring 245 to the receptacle base 220. In some embodiments, three extenders are equidistantly separated around the outer circumference of the contact ring 245 and three extenders are equidistantly separated around the inner circumference of the contact ring 245. In other embodiments, the placement of the three outer extenders and the placement of the three inner extenders are shifted by 60°.

Also, as illustrated in FIG. 2A, the N-ring 225 is crown-shaped comprising a base 225*a* having a predetermined height and a plurality of extenders 225*b*. In some embodiments, to reduce sharpness of a bottom edge of the base 225*a*, the bottom edge is rolled. Each of the plurality of extenders 225*b* is equidistantly separated around the circumference of the N-ring 225. The plurality of extenders 225*b* is sized and configured to insert through the fourth portion of the plurality of apertures 220*a* and a first portion of the plurality of openings 235*c* of the N-receptacle 235. The plurality of extenders 225*b* is configured to contact the N-receptacle 235.

Also, as illustrated in FIG. 2A, the L-ring 230 is crown-shaped comprising a base 230*a* having the same height as the base 225*a* and a plurality of extenders 230*b*. In some embodiments, to reduce sharpness of a bottom edge of the base 230*a*, the bottom edge is rolled. Each of the plurality of extenders 230*b* is equidistantly separated around the circumference of the L-ring 230. The plurality of extenders 230*b* is sized and configured to insert through the third portion of the plurality of apertures 220*a* and a first portion of the plurality of openings 215*c* of the L-receptacle 215. The plurality of extenders 230*b* is configured to contact the L-receptacle 215.

Device-Component Assembly

Figure 2G:
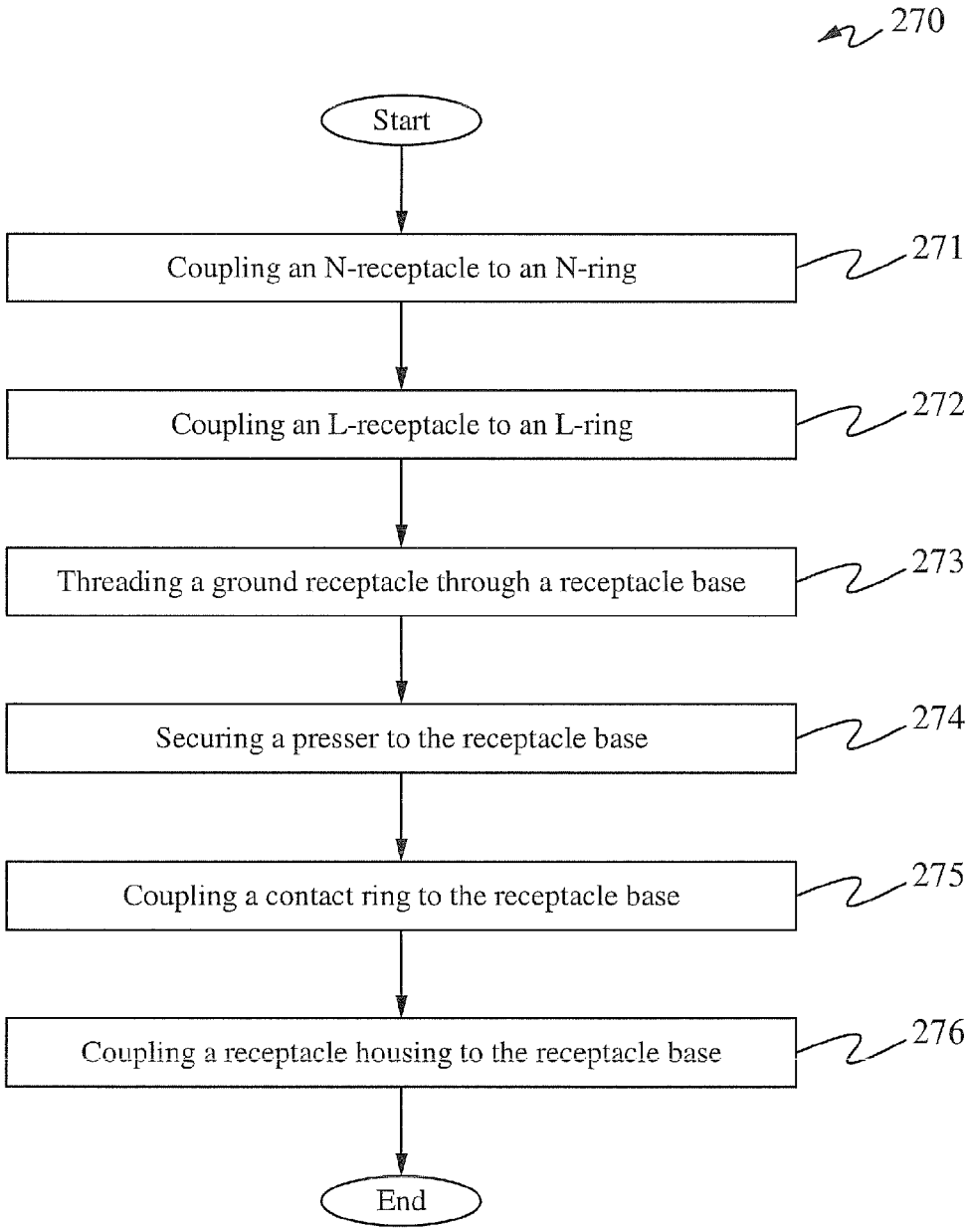
FIG. 2G illustrates a process of assembling the device-side component in accordance with the present invention.

FIG. 2G illustrates a process 200 of assembling the device-side component 200 in accordance with the present invention. The process 270 begins at a step 271 where the N-receptacle 235 is coupled to the N-ring 225 by positioning the N-receptacle 235 within the section 220*c* of the receptacle base 220. The plurality of extenders 225*b* of the N-ring 225 is inserted through the fourth portion of the plurality of apertures 220*a* of the receptacle base 220, typically from the bottom of the receptacle base 220. The plurality of extenders 225*b* of the N-ring 225 is then inserted through the first portion of the plurality of openings 235*c* of the N-receptacle 235, typically from the bottom of the open ring 235*b*. In some embodiments, the N-receptacle 235 is coupled to the N-ring 225 via spring urged pressure. In some embodiments, the N-receptacle 235 is soldered or welded to the N-ring 225 to provide a stronger coupling.

At a step 272, the L-receptacle 215 is coupled to the L-ring 230 by positioning the L-receptacle 215 within the section 220*b* of the receptacle base 220. The plurality of extenders 230*b* of the L-ring 230 is inserted through the third portion of the plurality of apertures 220*a* of the receptacle base 220, typically from the bottom of the receptacle base 220*a*. The plurality of extenders 230*b* of the L-ring 230 is then inserted through the first portion of the plurality of openings 215*c* of the L-receptacle 215, typically from the bottom of the open ring 215*b*. In some embodiments, the L-receptacle 215 is coupled to the L-ring 230 via spring urged pressure. Alternatively, the L-receptacle 215 is soldered or welded to the L-ring 230 to provide a stronger coupling.

At a step 273, the vertical prong 210*b* of the ground receptacle 210 is threaded through the center hole 220*g*, thereby positioning the ground receptacle 210 within the section 220*d* of the receptacle base 220.

At a step 274, the presser 240 is positioned above the vertical prong 210*b* to secure the ground receptacle 210 in place (e.g., to the receptacle base 220).

Figure 2H:
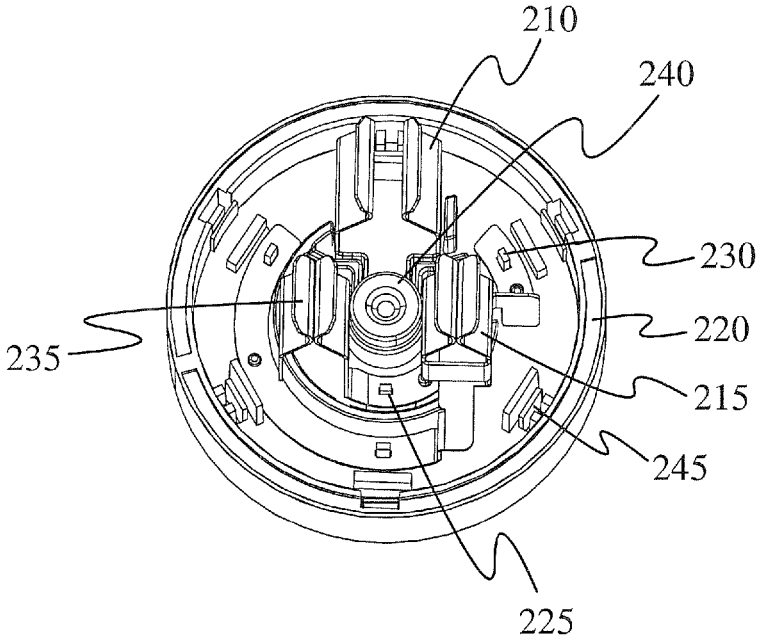
FIG. 2H illustrates an isometric view of the device-side component partially assembled in accordance with the present invention.

At a step 275, the contact ring 245 is coupled to receptacle base 220 by aligning the plurality of extenders 245*b* with the first and second portions of the plurality of apertures 220*a*. Once the plurality of extenders 245*b* are inserted through the corresponding apertures 220*a*, the flat ring 245*a* is typically positioned flush against the back side of the receptacle base 220, and the notches of the extenders 245*b* secures the contact ring 245 to the receptacle base 220. After the step 275, the device-side component is partially assembled, as illustrated in FIG. 2H. As illustrated, the receptacle base 220 is a hub for the L-receptacle 215, the N-receptacle 235, the presser 240, the ground receptacle 210, the contact ring 245, the L-ring 230, and the N-ring 225. In some embodiments, the step 275 can be performed prior to any of the previous steps.

At a step 276, the receptacle housing 205 is coupled to the receptacle base 220, thereby enclosing the pair of receptors 210*a* of the ground receptacle 210, the N-receptacle 235, the L-receptacle 215, and the presser 240. In some embodiments, the receptacle housing 205 and the receptacle base 220 are sonic welded together. Alternatively, the receptacle housing 205 and the receptacle base 220 are coupled together using soldering materials or other adhesives necessary to bind the casings 205, 220 together. Typically, the two vertical slots

205*a*, 205*b* and the role hole 205*c* of the receptacle housing 205 align with the N-receptacle 235, the L-receptacle 215, and the ground receptacle 210, respectively, prior to the coupling. After the step 276, the process 270 ends.

Figure 2I:
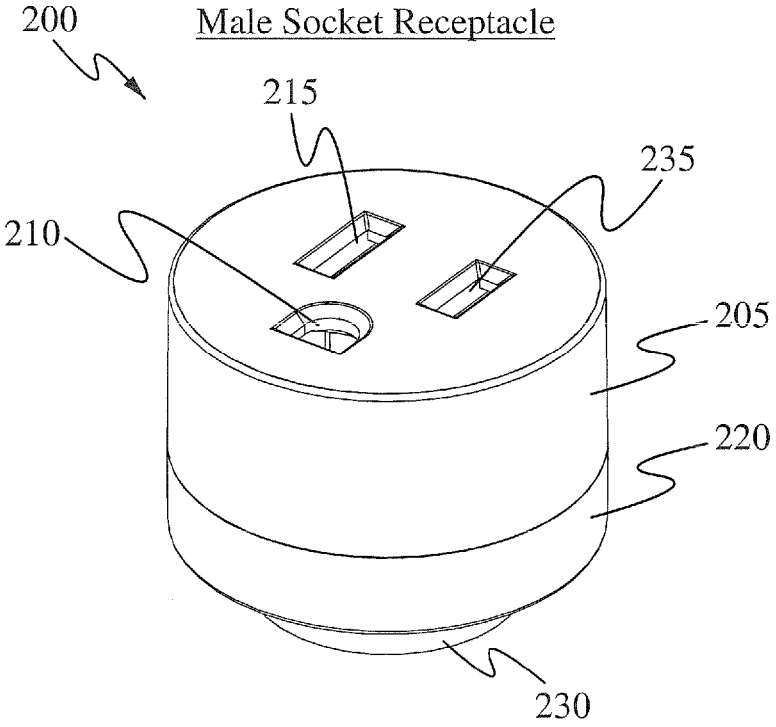
FIGS. 2I-2J illustrate different isometric views of the device-side component fully assembled in accordance with the present invention.
Figure 2J:
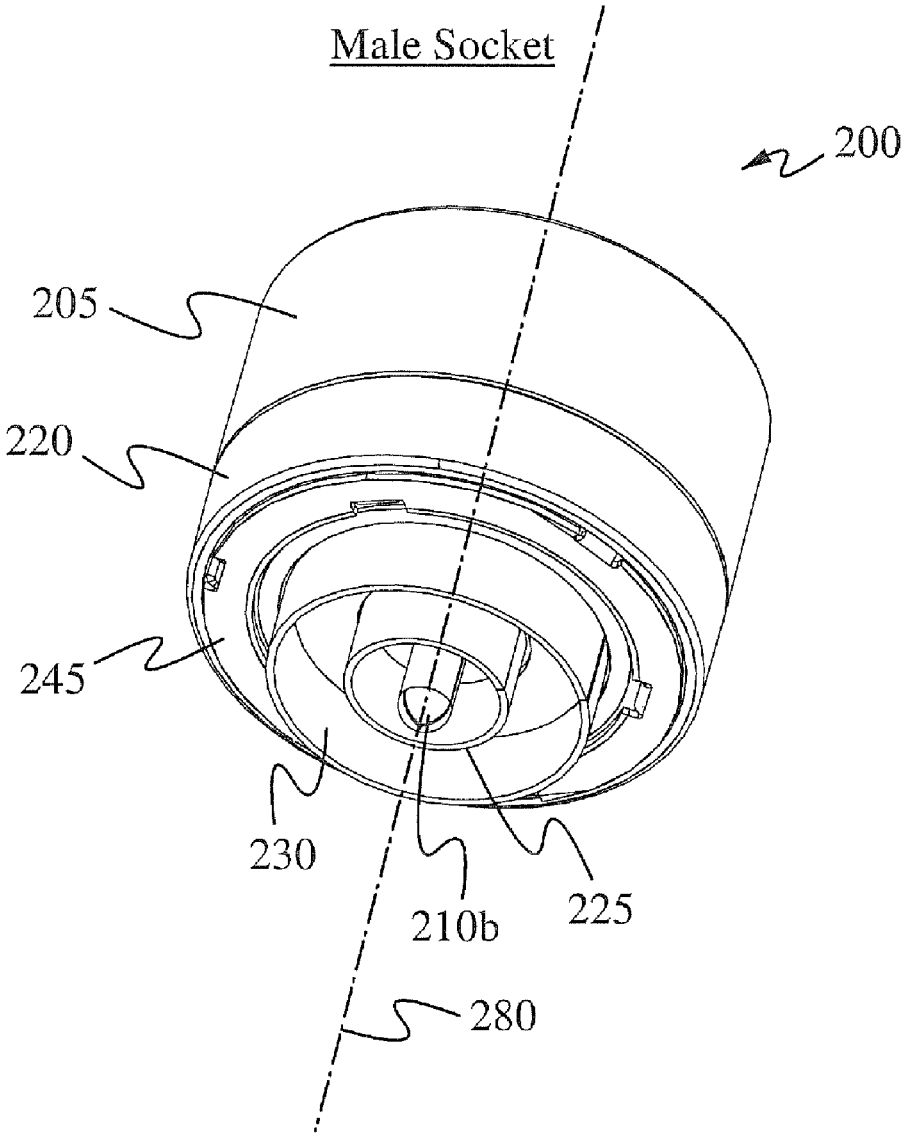

FIGS. 2I-2J illustrate different isometric views of the fully assembled device-side component 200 in accordance with the present invention. As illustrated in FIG. 2J, once the device-side component is assembled, the base 225*a* of the N-ring 225, the base 230*a* of the L-ring 230, and the vertical prong 210*b* of the ground receptacle 210 extend away from the receptacle housing 205. Typically, the base 225*a* and the base 230*a* extend away at the same distance, while the vertical prong 210*b* extends away at a further distance. Typically, the base 225*a*, the base 230*a* and the vertical prong 210*b* share a central axis 280. The base 225*a*, the base 230*a* and the vertical prong 210*b* typically make contact with various pieces of the wall-side component, as is discussed below.

Wall-Side Component Pieces

Figure 3A:
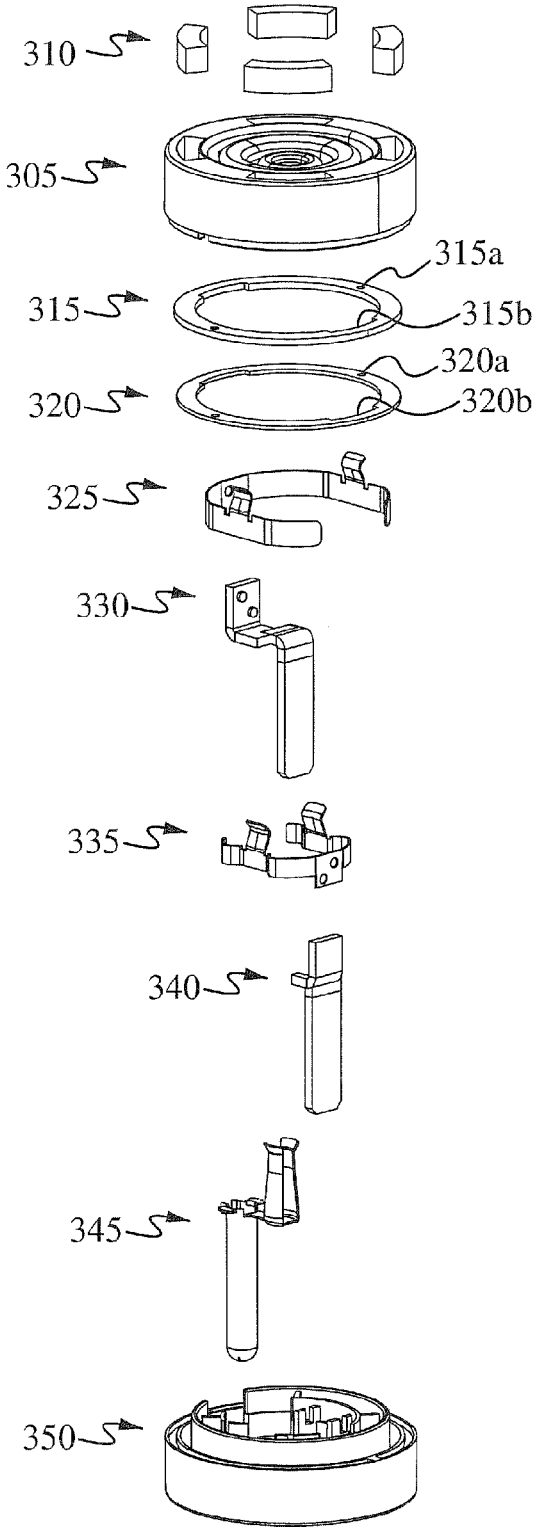
FIG. 3A illustrates an exploded view of various pieces of the wall-side component in accordance with the present invention.

FIG. 3A illustrates an exploded view of various pieces of the wall-side component 300 in accordance with the present invention. The wall-side component 300 typically includes socket housing 305, a plurality of magnets 310, a enhanced ring 315, an insulator 320, an L-conductor 325, an L-plug 330, an N-conductor 335, an N-plug 340, a ground plug 345, and a plug base 350. The socket housing 305, the insulator 320, and the plug base 350 are typically made of non-conductive material, such as plastic. The enhanced ring 315 is typically made of metal and is preferably steel. The plurality of magnets 310 and the enhanced ring 315 are typically zinc plated. The L-conductor 325, the L-plug 330, the N-conductor 335, the N-plug 340, and the ground plug 345 are typically made of conductive material, such as metal including phosphor bronze or beryllium copper.

Figure 3B:
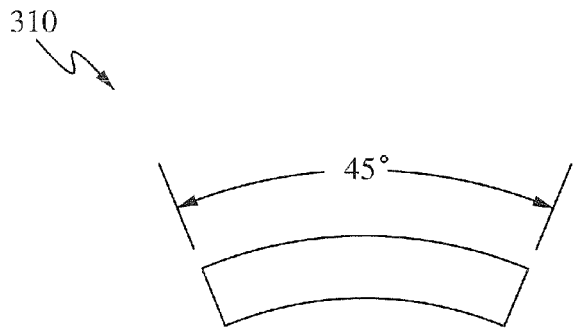
FIGS. 3B-3I illustrate the pieces of the wall-side component in accordance with the present invention.
Figure 6:
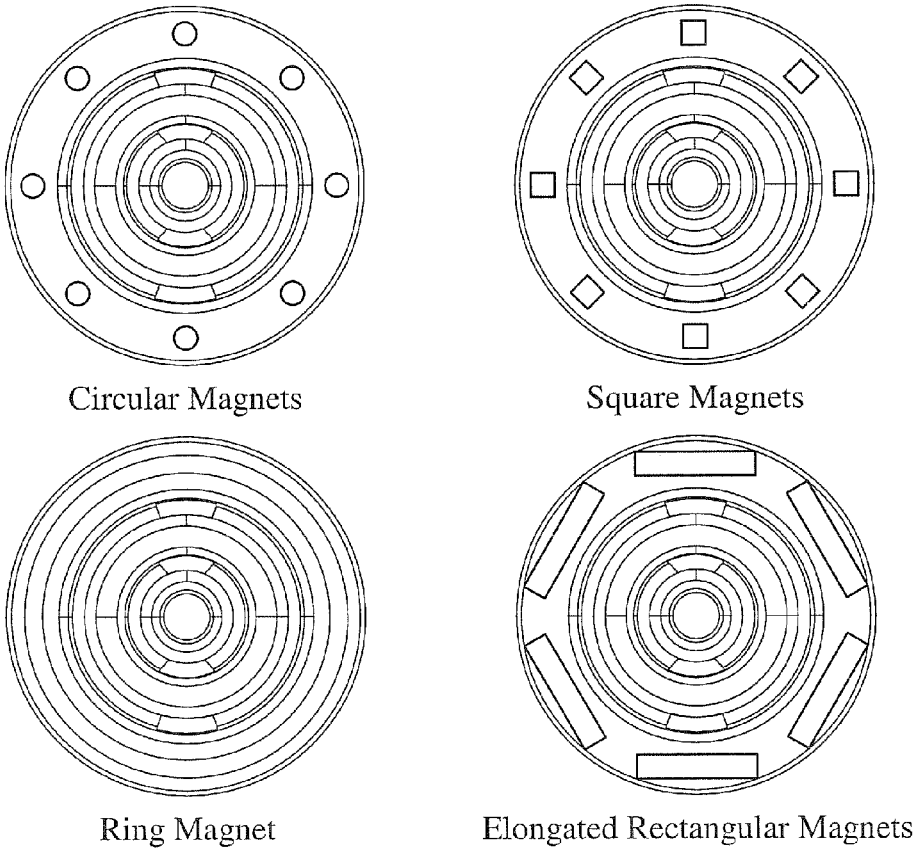
FIG. 6 illustrates exemplary configurations of magnets within the wall-side component in accordance with the present invention.

FIG. 3B illustrates a top view of a magnet 310 in accordance with the present invention. In some embodiments, the magnet 310 is fan-shaped. The width of the magnet 310 spans across 45°. The plurality of magnets 310, in some embodiments, includes two negative magnets and two positive magnets. Other shaped magnet circuits are contemplated, including those illustrated in FIG. 6. In some embodiments, a ring magnet, circular magnets, square magnets, or rectangular magnets are used.

Figure 3C:
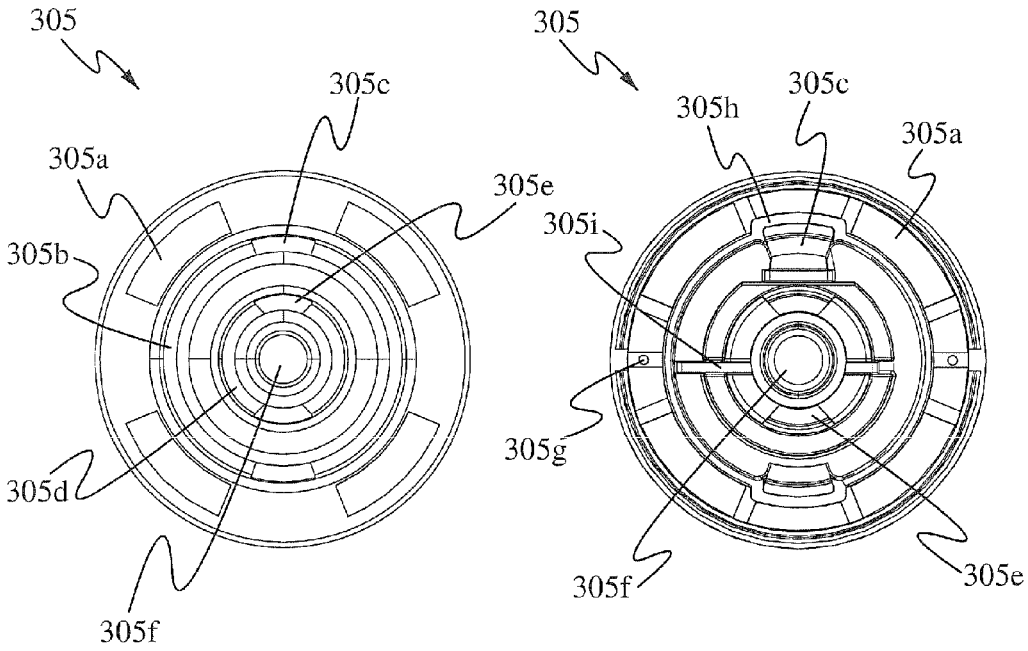

FIG. 3C illustrates a front view and a back view of the socket housing 305 in accordance with the present invention. As illustrated, the socket housing 305 typically comprises a plurality of chambers 305*a* sized and adapted to receive the plurality of magnets 310. In some embodiments, the chambers 305*a* are equidistantly separated apart around the perimeter of the socket housing 305. The front side of the socket housing 305 comprises two recessed rings or trenches 305*b*, 305*d* and a center opening 305*f*, each sized and adapted to receive the L-ring 230, the N-ring 225, and the vertical prong 210*b* of the ground receptacle 210, respectively. The rings 305*b*, 305*d* are preferably concentric rings and each has a pair of openings 305*c*, 305*e* to provide the L-ring 230 and the N-ring 225 contact with the L-plug 330 and the N-plug 340, respectively. The center opening 305*f* provides the vertical prong 210*b* contact with the ground plug 345. The back side of the socket housing 305 typically comprises a pair of pins 305*g* and a pair of clips 305*h*. The socket housing 305 also typically comprises a plurality of walls 305*i* therein to provide structural integrity of the socket housing 305. In some embodiments, the socket housing 305 is made by injection molding. Although the socket housing 305 is shown as having a circular shape, other shapes are contemplated.

As illustrated in FIG. 3A, the enhanced ring 315 and the insulator 320 are similarly shaped. The enhanced ring 315 includes a pair of holes 315*a* and a pair of notches 315*b*. The insulator 320 also includes a pair of holes 320*a* and a pair of notches 320*b*. The holes 315*a*, 320*a* are sized and adapted to receives the pair of pins 305*g* of the socket housing 305. The notches 315*b*, 320*b* are sized and adapted to receive the pair of clips 305*h* of the socket housing 305. The enhanced ring 315 and the insulator 320 are sized and adapted to fit around the circumference of and within the socket housing 305.

Figure 3D:
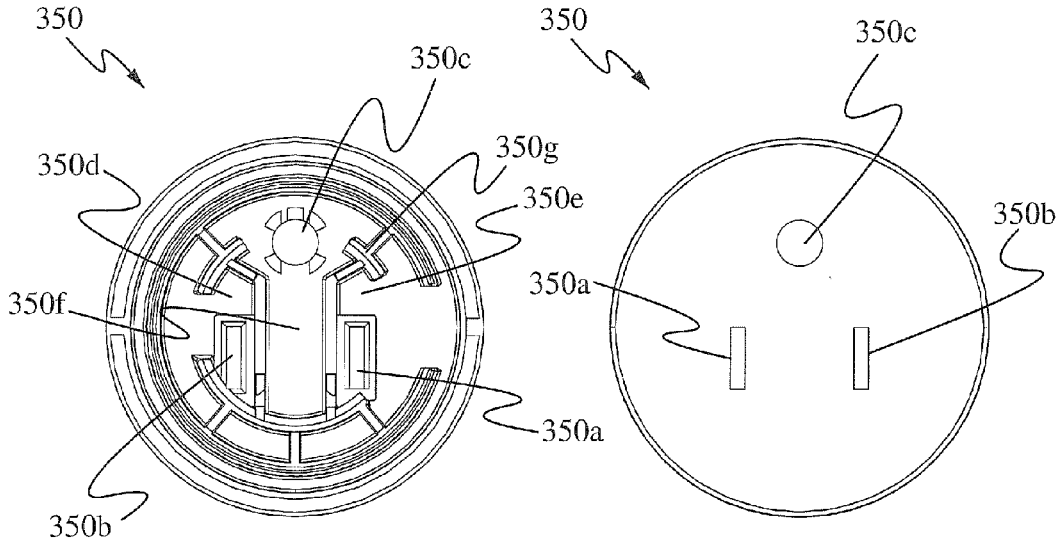

FIG. 3D illustrates a front view and a back view of the plug base 350 in accordance with the present invention. The plug base 350 typically comprises two vertical slots 350*a*, 350*b*. In some embodiments, the plug base 350 further comprises a substantially round hole 350*c*. The plug base 350 typically comprises a plurality of walls 350*g* therein to provide structural integrity of the plug base 350. The plurality of walls 350*g* is arranged to create a plurality of sections 350*d*-350*f* adapted to receive the L-conductor 325, the L-plug 330, the N-conductor 335, the N-plug 340 and the ground plug 345. In some embodiments, the body case 350 also comprises a plurality of ribs to affix the pieces therein in place. The two vertical slots 350*a*, 350*b* are sized and adapted to receive the L-plug 330 and the N-plug 340, respectively. The round hole 350*c* is sized and adapted to the ground plug 345. In some embodiments, the plug base 350 is made by injection molding. Although the plug base 350 is shown as having a circular shape, other shapes are contemplated.

Figure 3E:
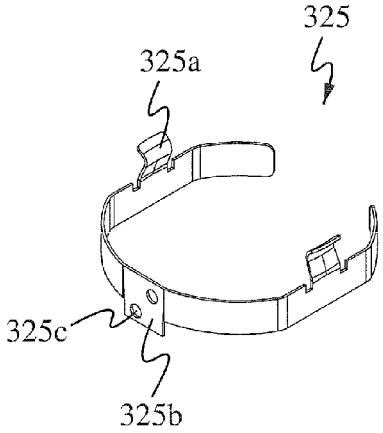

FIG. 3E illustrates an isometric view of the L-conductor 325 in accordance with the present invention. The L-conductor 325 is typically shaped as a horseshoe and typically comprises a pair of wings 325*a* along a top edge of the L-conductor 325, on opposite lengths of the L-conductor 325. In some embodiments, each of the wings 325*a* is bent to provide contact with the L-ring 230, particularly with the outer surface of the base 230*a*, through the pair of openings 305*c* of the socket housing 305. In some embodiments, a portion of each of the wings 325*a* further has convex points (not illustrated) to improve the contact surface. In some embodiments, the wings 325*a* are plated with platinum, or other suitable metal, to improve conductivity. The L-conductor 325 also comprises a contact plate 325*b*. In some embodiments, the contact plate 325*b* comprises holes 325*c*. In some embodiments, the L-conductor 325 is formed in a single stamping operation on sheet metal.

Figure 3F:
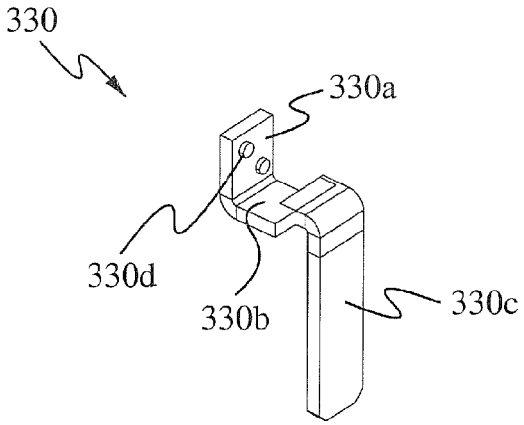

FIG. 3F illustrates an isometric view of the L-plug 330 in accordance with the present invention. The L-plug 330 typically comprises three sections: a contact plate 330*a*, an L-blade 330*c*, and a connector 330*b* that electrically connects the contact plate 330*a* with the L-blade 330*c*. In some embodiments, the contact plate 330*a* comprises protruding tabs 330*d* sized and adapted to fit within the holes 325*c* of the L-conductor 325. In some embodiments, the L-plug 330 is formed in a single stamping operation on sheet metal.

Figure 3G:
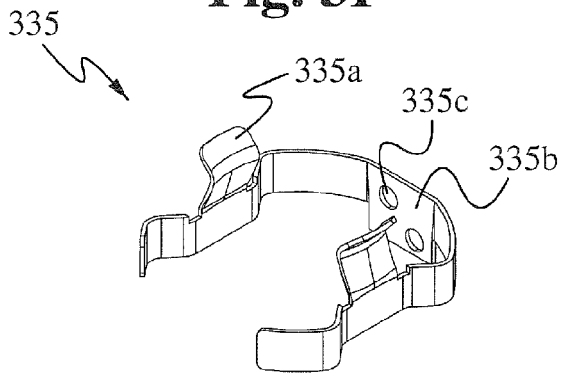

FIG. 3G illustrates an isometric view of the N-conductor 335 in accordance with the present invention. The N-conductor 335 is typically shaped as a horseshoe and typically comprises a pair of wings 335*a* along a top edge of the N-conductor 335, on opposite lengths of the N-conductor 335. In some embodiments, the lengths of the N-conductor 335 are bent. In some embodiments, each of the wings 335*a* is bent to provide contact with N-ring 225, particularly with the outer surface of the base 225*a*, through the pair of openings 305*e* of the socket housing 305. In some embodiments, a portion of each of the wings 335*a* further has convex points (not illustrated) to improve the contact surface. In some embodiments, the wings 335*a* are plated with platinum, or other suitable metal, to improve conductivity. The N-conductor 335 also comprises a contact plate 335*b*. In some embodiments, the contact plate 335*b* comprises holes 335*c*. In some embodiments, the N-conductor 335 is formed in a single stamping operation on sheet metal.

Figure 3H:
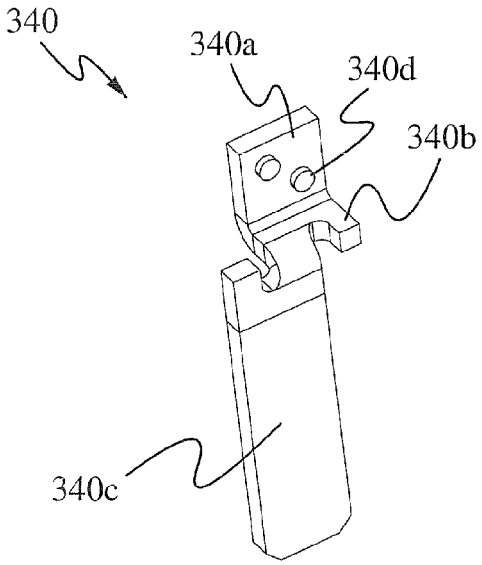

FIG. 3H illustrates an isometric view of the N-plug 340 in accordance with the present invention. The N-plug 340 typically comprises three sections: a contact plate 340*a*, an N-blade 340*c*, and a connector 340*b* that connects the contact plate 340*a* with the N-blade 340*c*. In some embodiments, the contact plate 340*a* comprises protruding tabs 340*d* sized and adapted to fit within the holes 335*c* of the N-conductor 335. In some embodiments, the N-plug 340 is formed in a single stamping operation on sheet metal.

Figure 3I:
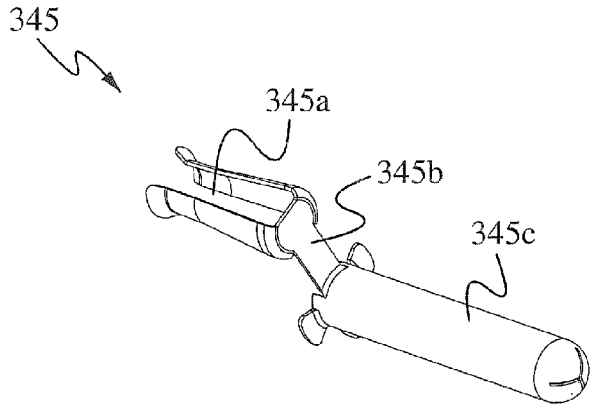

FIG. 3I illustrates an isometric view of the ground plug 345 in accordance with the present invention. The ground plug 345 typically comprises a pair of receptors 345*a* for receiving the vertical prong 210*b* of the ground receptacle 210. The ground plug 345 also comprises neutral prong 345*c* coupled to the pair of receptors 345*a* by a connector 345*b*. In some embodiments, the ground plug 345 is formed in a single stamping operation on sheet metal.

Wall-Side Component Assembly

Figure 3J:
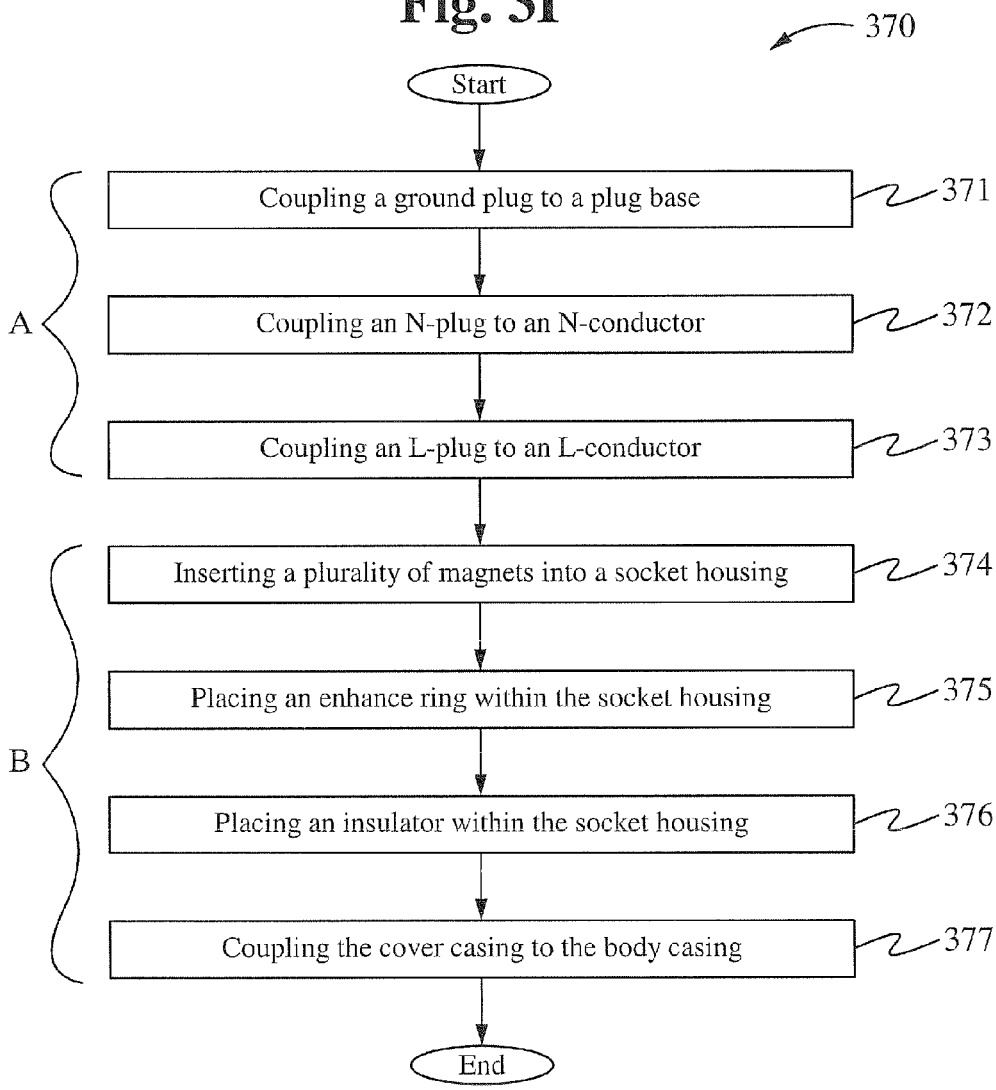
FIG. 3J illustrates a process of assembling the wall-side component in accordance with the present invention.

FIG. 3J illustrates a process 370 of assembling the wall-side component 300 in accordance with the present invention. The process 370 begins at a step 371 where the ground plug 345 is coupled to the plug base 350 by inserting the neutral prong 345*c* through the substantially round hole 350*c* of the plug base 350, thereby positioning the ground plug 345 within the section 250*f* such that the pair of receptors 345*a* is located at the center of the plug base 350.

At a step 372, the N-plug 340 is coupled to the N-conductor 335 by inserting the N-blade 340*c* through the slot 350*b* of the plug base 350 such that the protruding tabs 340*d* of the N-plug 340 face inwards. The N-conductor 335 is positioned within the section 350*e* of the plug base 350, guided by a portion of the plurality of walls 350*g*, such that the pair of wings 335*a* is at the top and the contact plate 335*b* faces the protruding tabs 340*d*. The tabs 340*d* are inserted through the holes 335*c* of the contact plate 335*b*. In some embodiments, the N-conductor 335 is coupled to the N-plug 340 via spring urged pressure. In some embodiments, the N-conductor 335 and the N-plug 340 are welded or soldered together to provide a stronger coupling.

At a step 373, the L-plug 330 is coupled to the L-conductor 325 by inserting the L-blade 330*c* through the slot 350*c* of the plug base 350 such that the protruding tabs 330*d* of the L-plug 330 face inwards. The L-conductor 325 is positioned within the section 350*d* of the plug base 350, guided by another portion of the plurality of walls 350*g*, such that the pair of wings 325*a* is at the top and the contact plate 325*b* faces the protruding tabs 330*d*. The tabs 330*d* are inserted through the holes 325*c* of the contact plate 325*b*. In some embodiments, the L-conductor 325 is coupled to the L-plug 330 via spring urged pressure. In some embodiments, the L-conductor 325 and the L-plug 330 are welded or soldered together to provide a stronger coupling.

Figure 3K:
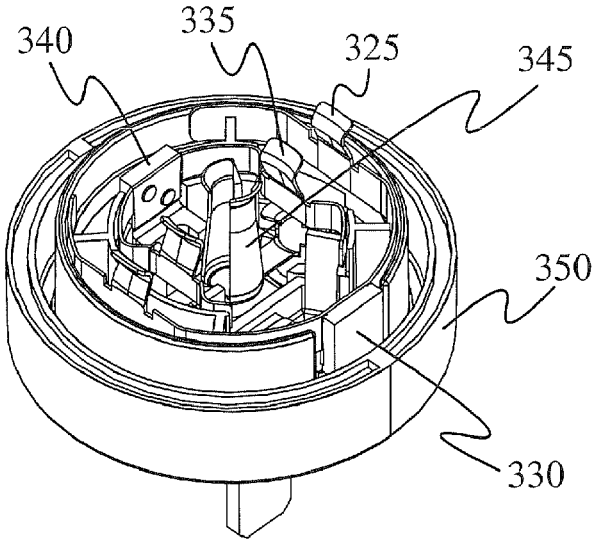
FIG. 3K illustrates an isometric view of the wall-side component partially assembled in accordance with the present invention.

In some embodiments, the step 372 and the step 373 are interchangeable. After the step 373, the wall-side component is partially assembled, as illustrated in FIG. 3K. The steps 371-373 make up the bottom part (A) of the wall-side component.

At a step 374, the plurality of magnets 310 are inserted into the plurality of chambers 305*a* of the socket housing 305. Top surfaces of the magnets 310, 315 are typically exposed at and flush with the top surface of the socket housing 305. In one embodiment, the magnets alternate in polarities to create a magnetic circuit that increases the strength of attraction, thereby providing a stronger attraction force.

At a step 375, an optional step, the enhanced ring 315 is placed within the socket housing 305 such that the pair of pins 305*g* of the socket housing 305 inserts through the pair of holes 315*a* of the enhanced ring 315, and the pair of notches 315*b* of the enhanced ring 315 is received by the pair of clips 305*h* of the socket housing 305.

At a step 376, the insulator 320 is placed within the socket housing 305, over the optional enhanced ring 315, such that the pair of pins 305*g* of the socket housing 305 inserts through the pair of holes 320*a* of the insulator 320 and the pair of notches 320*b* of the insulator 320 is received by the pair of clips 305*h* of the socket housing 305. The steps 374-376 make up the upper part (B) of the wall-side component. In some embodiments, the steps to make the upper part (B) can be performed before the steps to make the lower part (A).

At a step 377, the upper part (B) of the wall-side component is coupled to the lower part (A) of the wall-side component. The upper part (B) comprises the socket housing 305, which is a hub for the plurality of magnets 310, the enhanced ring 315, and the insulator 320. The lower part (A) comprises the plug base 350, which is a hub for the L-conductor 325, the L-plug 330, the N-conductor 335, the N-plug 340, and the ground plug 345. In some embodiments, the upper part (B) and lower part (A) are sonic welded together. Alternatively, the upper part (B) and lower part (A) are coupled together using soldering materials or other adhesives necessary to bind the two parts together. After the step 377, the process 370 ends.

Figure 3L:
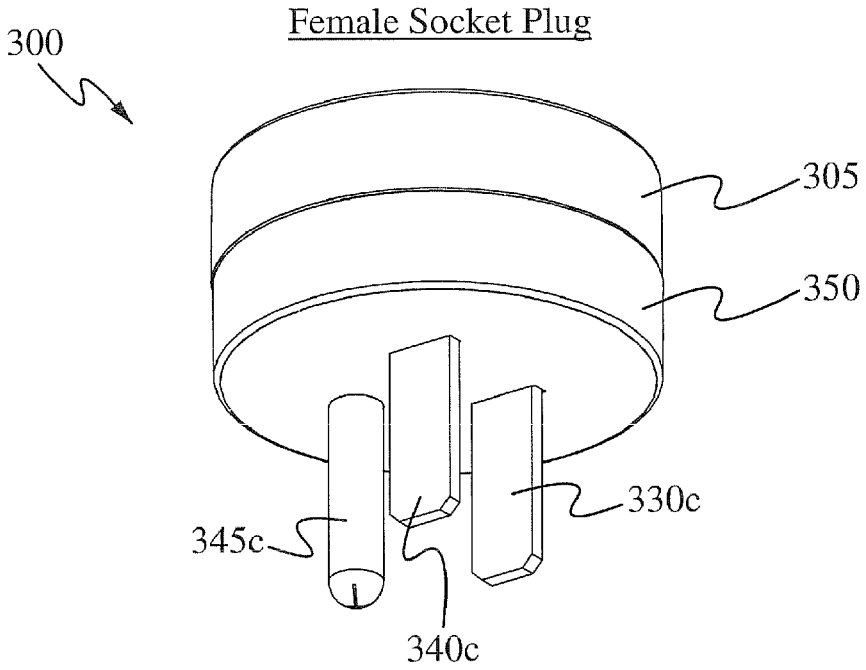
FIGS. 3L-3M illustrate different isometric views of the wall-side component fully assembled in accordance with the present invention.
Figure 3M:
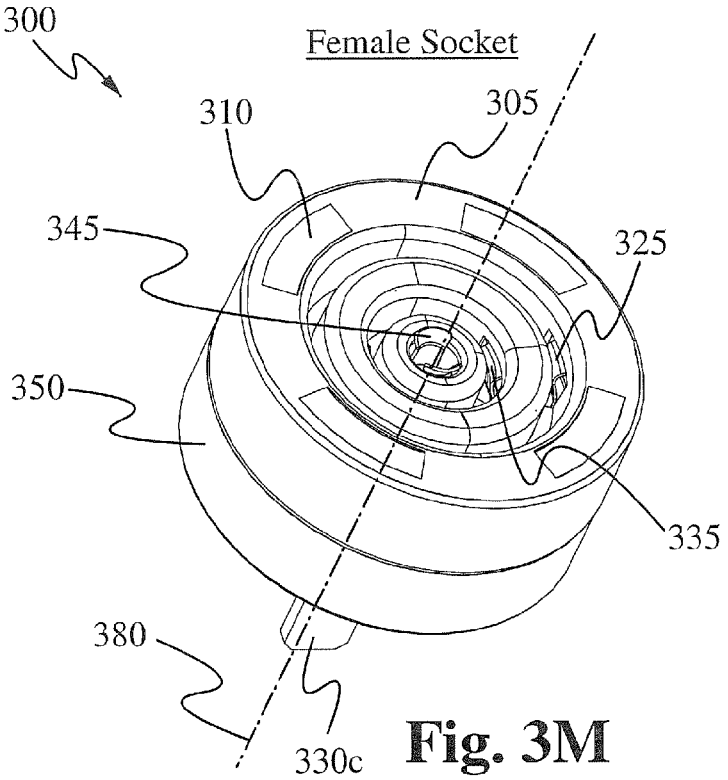

FIGS. 3L-3M illustrate different isometric views of the fully assembled wall-side component 300 in accordance with the present invention. As illustrated in FIG. 3L, once the device-side component is assembled, the N-blade 340*c*, the L-blade 330*c*, and the neutral prong 345*c* extend away from the plug base 350 and are configured to be inserted into an electrical outlet. As illustrated in FIG. 3M, the two recessed rings 305*b*, 305*d* and the center opening 305*f* share a central axis 380 and are configured to receive the L-ring 230, the N-ring 225 and the vertical prong 210*b* of the ground receptacle 210, respectively.

In Use

Figure 5:
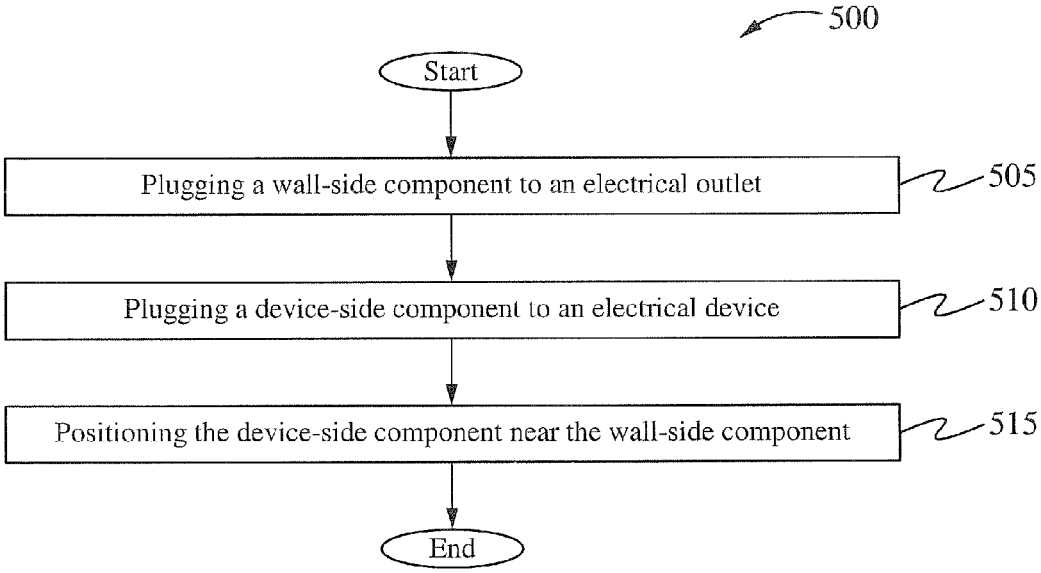
FIG. 5 illustrates a process of using the adapter in accordance with the present invention.

FIG. 5 illustrates a process 500 of using the adapter 400 in accordance with the present invention. The process 500 begins at a step 505 where the wall-side component 300 is plugged into an electrical socket. At a step 510, the device-side component 200 is plugged into an electrical device, such as a lamp. In some embodiments, the steps 505 and 510 are interchangeable. At a step 515, the device-side component 200 is positioned within an attraction vicinity of the wall-side component 300. In some embodiments, the attraction vicinity has a range of approximately 1 cm, although other ranges are possible depending on the number of and types of magnets used. When the device-side component 200 is within the attraction vicinity of the wall-side component 300, the magnets 310 on the wall-side component 300 typically attract the contact ring 245 of the device-side component 200. Typically, the female socket interface of the wall-side component 200 is adapted to receive the male socket interface of the device-side component 200. After the step 515, the process 500 ends.

When the device-side component 200 engages with the wall-side component 300, the L-ring 230 is inserted into the outer recessed ring 305*b*, the N-ring 225 is inserted into the inner recessed ring 305*d*, and the vertical prong 210*b* of the ground receptacle 210 is inserted into the center opening 305*f*. The L-ring 230 is in contact with the L-plug 330 via the L-conductor 325. In particular, the wings 325*a* of the L-conductor 325 sweep and wipe the outer surface of the base 230*a* of the L-ring 230. The N-ring 225 is in contact with the N-plug 340 via the N-conductor 335. In particular, the wings 335*a* of the N-conductor 335 sweep and wipe the outer surface of the base 225*a* of the N-ring 225. The ground receptacle 210 is in contact with the ground plug 345. Electricity is able to pass into the L-plug 330, to the L-conductor 325, to the L-ring 230, to the L-receptacle 215, into the hot side of device's plug, into the device, then out through the neutral side of the device's plug, to the N-receptacle 235, to the N-ring 225, to the N-conductor 335, to the N-plug 340 and to an electrical panel.

Advantages

When the device-side component 200 is within the attraction vicinity, the device-side component 200 is advantageously pulled toward the wall-side component 300, allowing a user to simply dangle the device-side component 200 in front of the wall-side component 300 in hard to reach areas or limited access areas. In particular, the magnets within the wall-side component 300 attract the contact ring of the device side component 200. In addition, since the adapter 400 has a radial design, the user need not be concerned with face orientation or directionality, as the user normally would while slotting a standard electrical plug into a standard electrical outlet. Put differently, the radial design of the adapter 400 advantageously allows the user to need not worry about precisely aligning any parts. Furthermore, a user becomes more efficient in plugging an electrical device into an electrical outlet simply because the size of the electrical outlet has become bigger.

Applications

The adapter 400 is able to be used in a number of applications. In the following applications, the wall-side component 300 and the device-side component 200 are used with existing electrical outlets and plugs of electrical devices. Examples of low voltage applications include mobile devices, such as cell phones, PDAs, and laptops. Examples of standard voltage applications include desktop computers, vacuum cleaners, and lamps. Examples of high voltage applications include appliances, such as refrigerators, washing machines, and dryers. It should be understood that the applications provided are not exhaustive but illustrate only a handful of typical uses.

Other Embodiments

Figure 7:
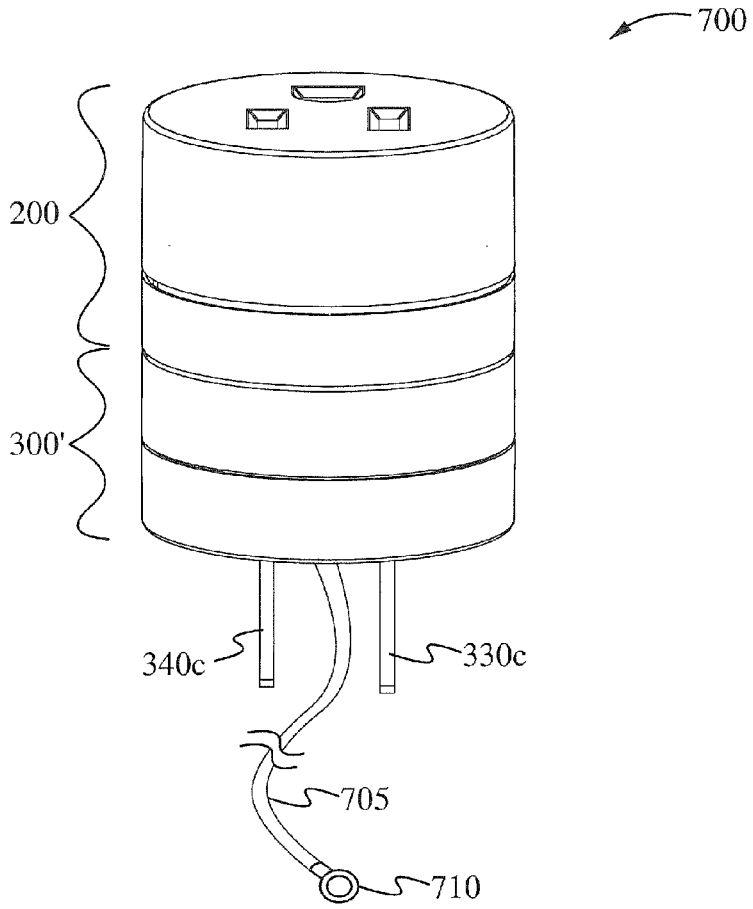
FIG. 7 illustrates an isometric view of another exemplary adapter in accordance with the present invention.

FIG. 7 illustrates another exemplary adapter 700 in accordance with the present invention. Similar to the adapter 400, the adapter 700 also includes a device-side component 200 and a wall-side component 300'. The wall-side component 300' comprises an N-blade 340*c* and an L-blade 330*c*, as described above. However, instead of a neutral prong 345*c* of a ground plug 345, the wall-side component 330' comprises a grounding wire 705 with a loop 710. The loop 710 is either an open or a closed loop. A ground is typically provided when the loop 710 is screwed under the screw of the faceplate.

In some embodiments, the device-side component also comprises magnets so that the device-side component and the wall-side component are mutually attractive.

In some embodiments, the wall-side component also comprises a safety feature to turn the electrical circuit off when the device-side component is not coupled to the wall-side component.

Figure 8:
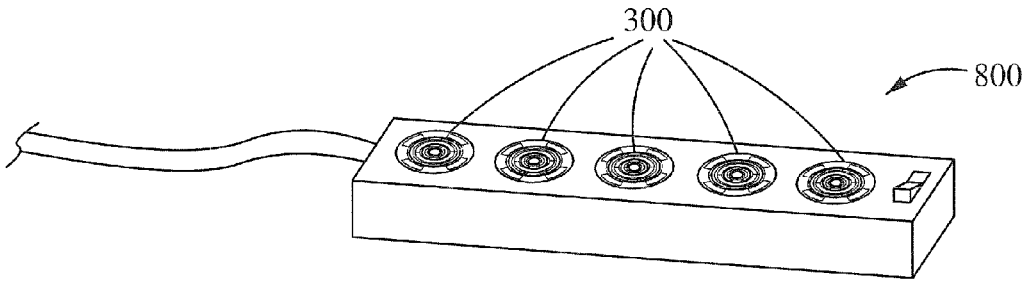
FIG. 8 illustrates an exemplary power strip in accordance with the present invention.
Figure 9:
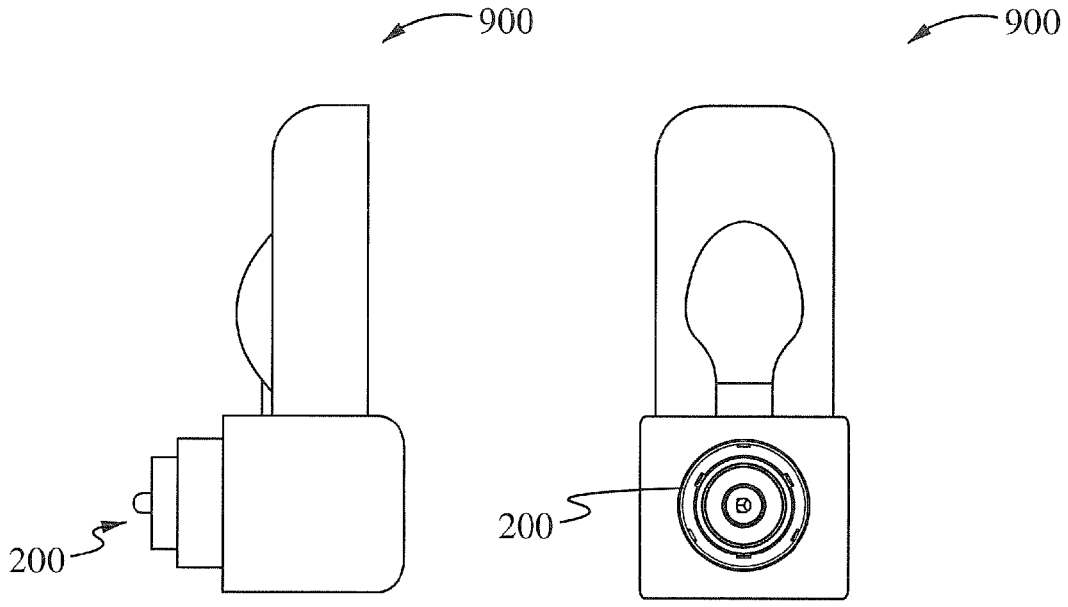
FIG. 9 illustrates an exemplary night light in accordance with the present invention.

In some embodiments, wall-side components are built as part of electrical outlets of buildings or as part of power strips, such as that illustrated in FIG. 8. In some embodiments, a device-side component is built as part of or replaces a traditional plug of an electrical device, such as a night light illustrated in FIG. 9. In FIG. 9, both a side view and a back view are shown. It should be understood that the embodiments are only exemplary and do not limit the invention in anyway. In fact, it is envisioned that a line of product accessories will fit in with this core architecture (e.g., device-side component, wall-side component) of the present invention.

The present invention has been described in terms of specific embodiments incorporating details to facilitate the understanding of principles of construction and operation of the invention. Such reference herein to specific embodiments and details thereof is not intended to limit the scope of the claims appended hereto. A person skilled in the art would appreciate that various modifications and revisions to an apparatus for and method of magnetically coupling standard electrical plugs will occur. Consequently, the claims should be broadly construed, consistent with the spirit and scope of the invention, and should not be limited to their exact, literal meaning.

What is claimed is:

1. An adapter comprising a non-orientation dependent pair of connectors, wherein the connectors include:

a. a first connector including:
   i. a male socket receptacle; and
   ii. a male socket opposite the male socket receptacle, the male socket comprising at least two concentric rings protruding from the first connector; and b. a second connector including:
   i. a female socket plug; and
   ii. a female socket opposite the female socket plug, the female socket configured to mate with the male socket.

2. An adapter comprising orientation independent connectors, wherein the connectors are magnetically attractive, wherein the connectors include:

a. a first connector configured to couple with an electronic device, the first connector comprising a first interface, the first interface including a plurality of protruding rings; and b. a second connector configured to couple with an electrical outlet, the second connector comprising a second interface, wherein the first interface and the second face are pulled together and mate when the first connector is within an attraction vicinity of the second connector.

3. An adapter comprising:

a. a first removable component comprising:
   i. a piece capable of being attracted by magnets; and
   ii. a first removable component interface with a radial design including a plurality of rings; and b. a second removable component comprising:
   i. at least one magnet;
   ii. a second removable component interface to receive the plurality of rings, wherein the at least one magnet attracts the piece capable of being attracted by magnets to guide the first removable component into the second removable component, regardless of how the first removable component interface is oriented with respect to the second removable component interface.

4. An adapter comprising:

a. a device-side component including:
   i. a first device face configured to receive an electrical plug;
   ii. a second device face opposite the first device face;
   iii. an L-receptacle configured to receive a first prong of the electrical plug;
   iv. an L-ring abutting the L-receptacle, wherein a portion of the L-ring protrudes from the second device face;
   v. an N-receptacle configured to receive a second prong of the electrical plug; and vi. an N-ring abutting the N-receptacle, wherein a portion of the N-ring protrudes from the second device face; and b. a wall-side component including:

i. a first wall face configured to insert into an electrical outlet;

ii. a second wall face opposite the first wall face, wherein the second wall face is configured to mate with the second device face, regardless of orientation of the second device face with respect to the second wall face;

iii. an L-conductor configured to contact the portion of the L-ring protruding from the second device face;

iv. an L-plug coupled to the L-conductor, wherein a portion of the L-plug is configured to insert into a first slot of the electrical outlet;

v. an N-conductor configured to contact the portion of the N-ring protruding from the second device face; and vi. an N-plug coupled to the N-conductor, wherein a portion of the N-plug is configured to insert into a second slot of the electrical outlet.

5. The adapter of claim 4 wherein the device-side component further comprises a ground receptacle configured to receive a third prong of the electrical plug.

6. The adapter of claim 4 wherein the device-side component further comprises a ring capable of being attracted by at least one magnet.

7. The adapter of claim 4 wherein the device-side component further comprises at least one magnet.

8. The adapter of claim 4 wherein the wall-side component further comprises a ground plug configured to receive a ground receptacle, wherein a portion of the ground plug is configured to insert into a hole of the electrical outlet.

9. The adapter of claim 4 wherein the wall-side component further comprises a grounding wire.

10. The adapter of claim 4 wherein the wall-side component further comprises at least one magnet.

11. A device-side component of an adapter comprising:

a. a receptacle housing including an interface to receive an electrical plug;

b. a receptacle base coupled to the receptacle housing, wherein the receptacle base includes an interface to couple with a wall-side component;

c. an L-receptacle configured to receive a first blade of the electrical plug;

d. an L-ring coupled to the L-receptacle, wherein a portion of the L-ring extends away from a bottom of the receptacle base;

e. an N-receptacle configured to receive a second blade of the electrical plug; and f. an N-ring coupled to the N-receptacle, wherein a portion of the N-ring extends away from the bottom of the receptacle base, wherein the L-ring and N-ring are concentric rings.

12. The device-side component of claim 11 further comprising a ground receptacle configured to receive a ground prong of the electrical plug, wherein a portion of the ground receptacle extends through and away from the receptacle base.

13. The device-side component of claim 11 further comprising a presser.

14. The device-side component of claim 11 further comprising an element capable of being attracted by a magnet, wherein the element is coupled to the bottom of the receptacle base.

15. The device-side component of claim 11 wherein the device-side component is formed as part of an electrical device.

16. A wall-side component of an adapter comprising:

a. a socket housing including an interface to couple to a device-side component, wherein the interface comprises two recessed, concentric rings;

b. a plug base coupled to the socket housing, wherein the plug base includes an interface to plug into an electrical outlet;

c. an L-conductor configured to contact an L-ring of the device-side component;

d. an L-plug coupled to the L-conductor, wherein a portion of the L-plug extends away from a bottom of the plug base, wherein the portion of the L-plug is configured to insert into a first slot of the electrical outlet;

e. an N-conductor configured to contact an N-ring of the device-side component; and f. an N-plug coupled to the N-conductor, wherein a portion of the N-plug extends away from the bottom of the plug base, wherein the portion of the N-plug is configured to insert into a second slot of the electrical outlet.

17. The wall-side component of claim 16 further comprising at least one magnet positioned within the socket housing.

18. The wall-side component of claim 17 further comprising an enhanced ring sized and adapted to fit within the socket housing.

19. The wall-side component of claim 17 further comprising an insulator sized and adapted to fit within the socket housing.

20. The wall-side component of claim 16 further comprising a ground plug configured to receive a ground receptacle of a device-side component, wherein a portion of the ground plug is configured to insert into a third slot of the electrical outlet.

21. The wall-side component of claim 16 further comprising a grounding wire.

22. The wall-side component of claim 16 wherein the wall-side component is formed as part of an electrical outlet.

* * * * *